US011251588B1

(12) United States Patent
Woo

(10) Patent No.: US 11,251,588 B1
(45) Date of Patent: Feb. 15, 2022

(54) DUAL SPARK PLUG

(71) Applicants: HYUNDAI MOTOR COMPANY, Seoul (KR); KIA CORPORATION, Seoul (KR)

(72) Inventor: Soo Hyung Woo, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/350,743

(22) Filed: Jun. 17, 2021

(30) Foreign Application Priority Data

Dec. 11, 2020 (KR) ..... 10-2020-0173537

(51) Int. Cl.
*H01T 13/22* (2006.01)
*H01T 13/38* (2006.01)

(52) U.S. Cl.
CPC ..... *H01T 13/22* (2013.01); *H01T 13/38* (2013.01)

(58) Field of Classification Search
CPC ..... H01T 13/22
See application file for complete search history.

(56) References Cited

U.S. PATENT DOCUMENTS

2017/0229844 A1* 8/2017 Minami ..... H01T 13/08

* cited by examiner

*Primary Examiner* — Anne M Hines
(74) *Attorney, Agent, or Firm* — Lempia Summerfield Katz LLC

(57) ABSTRACT

A dual spark plug may include: a cap plug formed of an insulation material; an upper body formed of an insulation material and coupled with the cap plug; a lower body integrally formed with the upper body and provided at an outer side of the upper body; a pair of plug center electrodes provided inside the cap plug; a pair of upper center electrodes provided inside the upper body and electrically connected with the pair of plug center electrodes; insulation caps provided to wrap the pair of plug center electrodes, respectively; and a pair of ground electrodes extended from opposite sides of the lower body and disposed at a predetermined distance from the pair of upper center electrodes, respectively.

12 Claims, 5 Drawing Sheets

DUAL SPARK PLUG

CROSS-REFERENCE TO RELATED APPLICATION

This application claims priority to and the benefit of Korean Patent Application No. 10-2020-0173537 filed in the Korean Intellectual Property Office on Dec. 11, 2020, the entire contents of which are incorporated herein by reference.

BACKGROUND

(a) Field of the Disclosure

The present disclosure relates to a dual spark plug. More particularly, the present disclosure relates to a dual spark plug that is capable of efficiently igniting a lean mixture in an engine of a gasoline vehicle.

(b) Description of the Related Art

A mixture of air and fuel is ignited by a spark generated by a spark plug, thereby combusting fuel in a gasoline vehicle. In other words, the mixture injected into a combustion chamber during a compression stroke is ignited by the discharge phenomenon of the spark plug. Energy required for the vehicle's driving is generated while undergoing a high-temperature and high-pressure expansion process.

The spark plug provided in the gasoline vehicle serves to ignite the compressed mixture by spark discharge by a high voltage current generated from an ignition coil.

In the case of a general gasoline engine, it is mainly operated to combust with a theoretical air/fuel ratio (14.7:1, $\lambda=1$).

However, in the case of an engine to implement lean burn combustion, the air/fuel ratio is approximately 30:1 $\lambda=2$. In this case, the mixer in the combustion chamber has very little injected fuel compared to the amount of air. Thus, even if spark discharge occurs by the spark plug, the mixture does not ignite (misfires), or incomplete combustion occurs.

Therefore, research and development of spark plugs to implement lean burn combustion are required.

The above information disclosed in this Background section is only to enhance understanding of the background of the disclosure. Therefore, the Background section may contain information that does not form the prior art that is already known in this country to a person having ordinary skill in the art.

SUMMARY

The present disclosure is to solve the above-described problem and is to provide a dual spark plug that is capable of efficiently combusting a lean fuel mixture supplied in a combustion chamber and securing insulation between center electrodes.

In order to achieve the above-stated purpose, a dual spark plug according to an embodiment of the present invention may include: a cap plug formed of an insulation material; an upper body that is coupled with the cap plug and formed of an insulation material; a lower body that is integrally formed with the upper body, and is provided at an outer side of the upper body; a pair of plug center electrodes provided inside the cap plug; a pair of upper center electrodes provided inside the upper body and electrically connected with the pair of plug center electrodes; insulation caps provided to wrap the pair of plug center electrodes, respectively; and a pair of ground electrodes extended from opposite sides of the lower body and disposed at a predetermined distance from the pair of upper center electrodes, respectively.

An upper insertion groove may be formed in a lower part of the cap plug. An upper exterior diameter of the upper body may be formed to correspond to an interior diameter of the upper insertion groove such that the upper body is inserted into the upper insertion groove.

The pair of plug center electrodes wrapped with the insulation caps may extend into the upper insertion groove. A pair of plug holes may be formed in the upper body for insertion of the pair of center electrodes extended into the upper insertion groove.

In the cap plug, a central terminal that is electrically connected with one of the pair of plug center electrodes may be provided and an outer terminal that is electrically connected with the other one of the pair of plug center electrodes may be provided.

The outer terminal may be disposed to be spaced a predetermined distance from the central terminal in up and down directions and may be disposed to be spaced a predetermined distance from the central terminal at an outside in the radial direction of the central terminal.

The outer terminal may be formed in a ring shape with an empty center.

The pair of upper center electrodes may be provided inside the plug hole. Ends of the pair of upper center electrodes may be formed as clip-type terminals such that the upper center electrodes are electrically connected with the pair of plug center electrodes.

Ends of the pair of plug center electrodes may be forcibly fitted into the pair of upper center electrodes that are provided as clip-type terminals.

At least one upper guide protrusion may be formed in an interior side of the upper insertion groove of the cap plug. A lower guide groove that corresponds to the upper guide protrusion may be formed in an exterior circumference of the upper body.

At least one upper guide groove may be formed in an interior side of the upper insertion groove of the cap plug. A lower guide protrusion that corresponds to the upper guide groove may be formed in an exterior circumference of the upper body.

A thread may be formed in an exterior circumference of the lower body.

The upper body and the lower body may be integrally formed.

The dual spark plug according to the above-stated embodiments of the present disclosure can prevent an air gap from being formed between a pair of electrodes, thereby assuring insulation between the pair of electrodes.

BRIEF DESCRIPTION OF THE DRAWINGS

Since these drawings are for reference only to explain embodiments of the present disclosure, the technical idea of the present disclosure should not be interpreted as being limited to the accompanying drawings.

DETAILED DESCRIPTION

Figure 1:
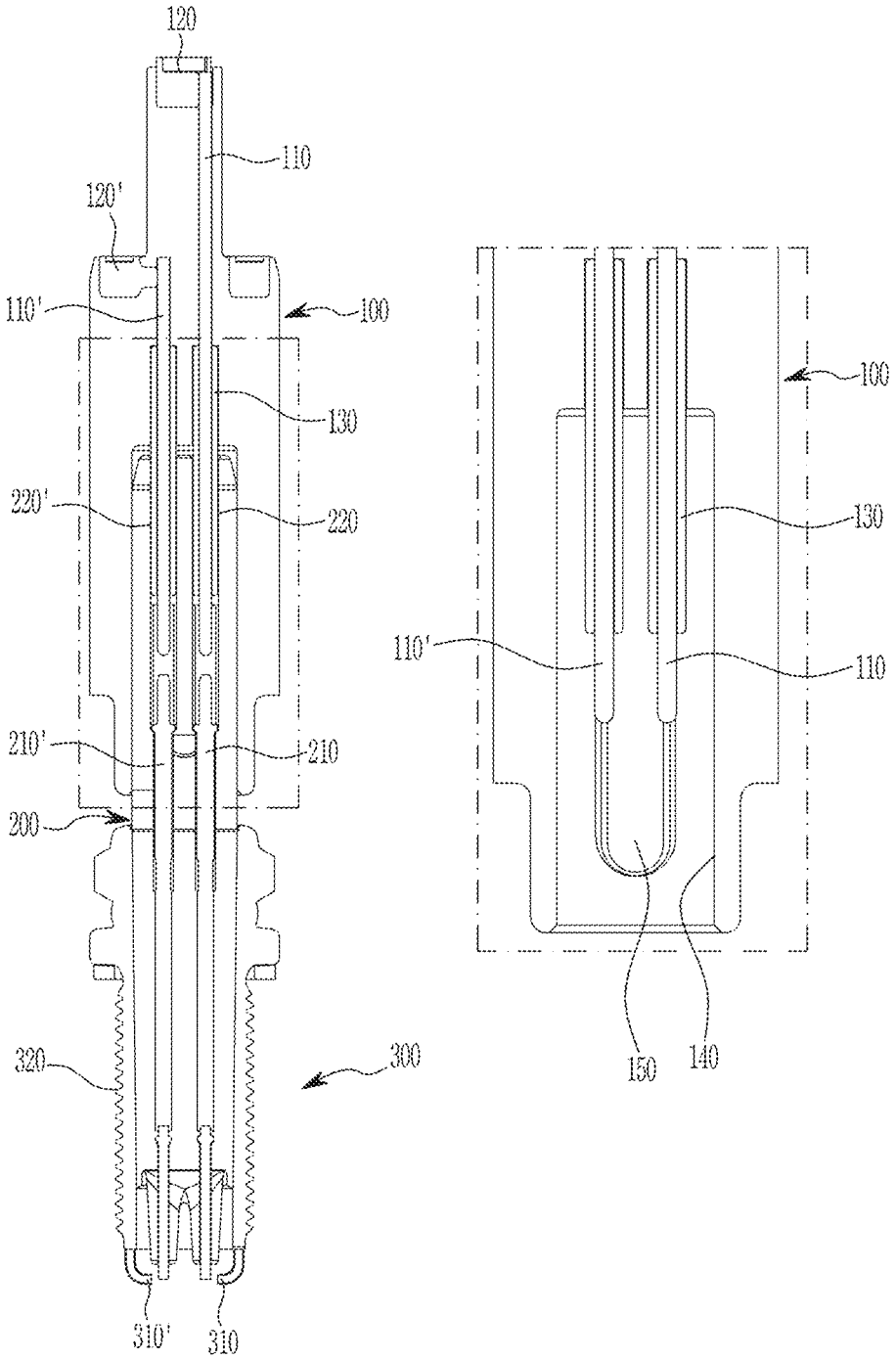
FIG. 1 is a cross-sectional view of a configuration of a dual spark plug according to an embodiment of the present disclosure.

The present disclosure is described more fully hereinafter with reference to the accompanying drawings, in which embodiments of the disclosure are shown. As those having ordinary skill in the art should realize, the described embodiments may be modified in various different ways, all without departing from the spirit or scope of the present disclosure.

The drawings and description are to be regarded as illustrative in nature and not restrictive. Like reference numerals designate like elements throughout the specification.

In addition, the size and thickness of each component shown in the drawing are shown arbitrarily for convenience of description. Thus, the present disclosure is not necessarily limited to what is shown in the drawing, and in order to clearly express the various parts and areas, the thickness is enlarged.

Hereinafter, a dual spark plug according to an embodiment of the present disclosure is described in detail with reference to the accompanying drawings.

Figure 2:
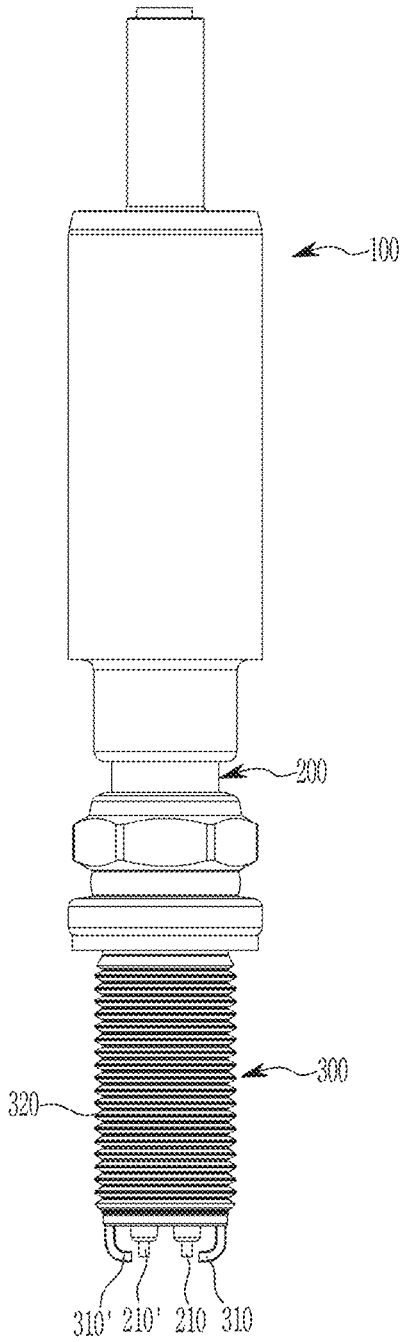
FIG. 2 is a side view of the configuration of the dual spark plug according to the embodiment of the present disclosure.
Figure 3:
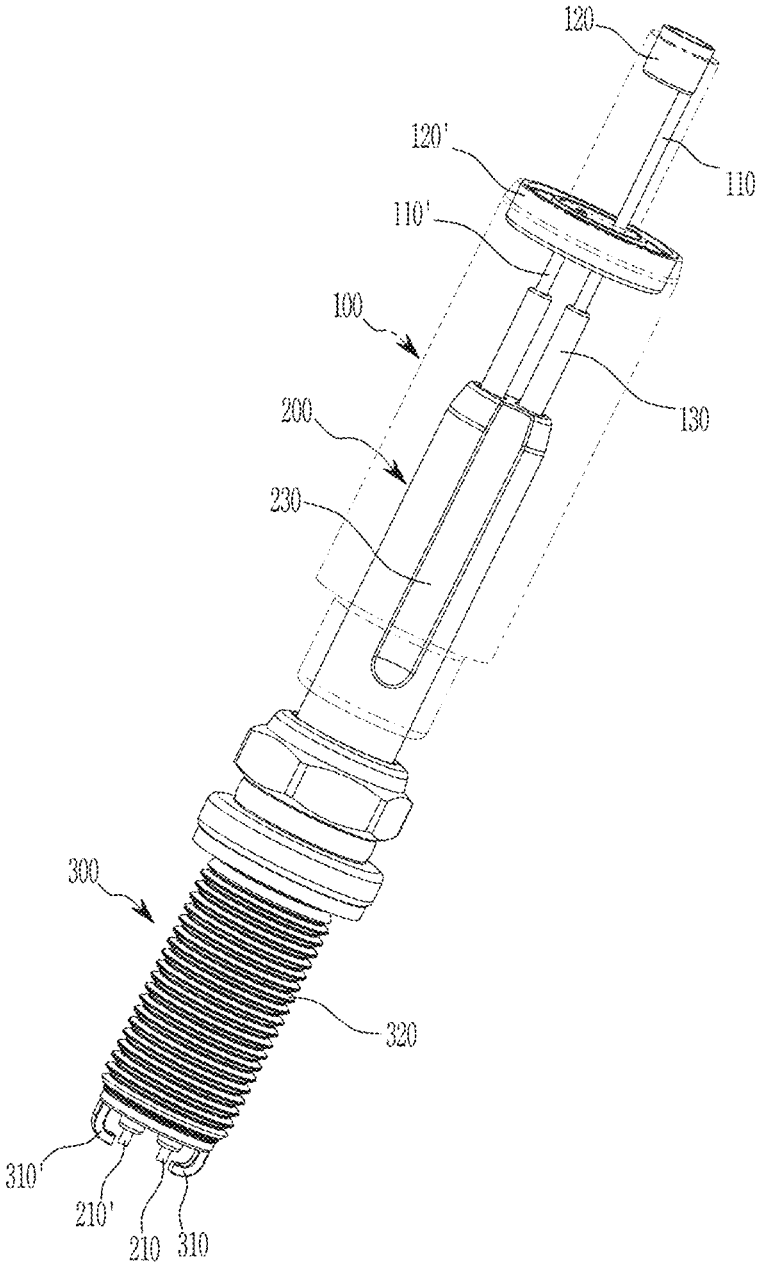
FIG. 3 is a transparent perspective view of a part of the dual spark plug according to the embodiment of the present disclosure.
Figure 4:
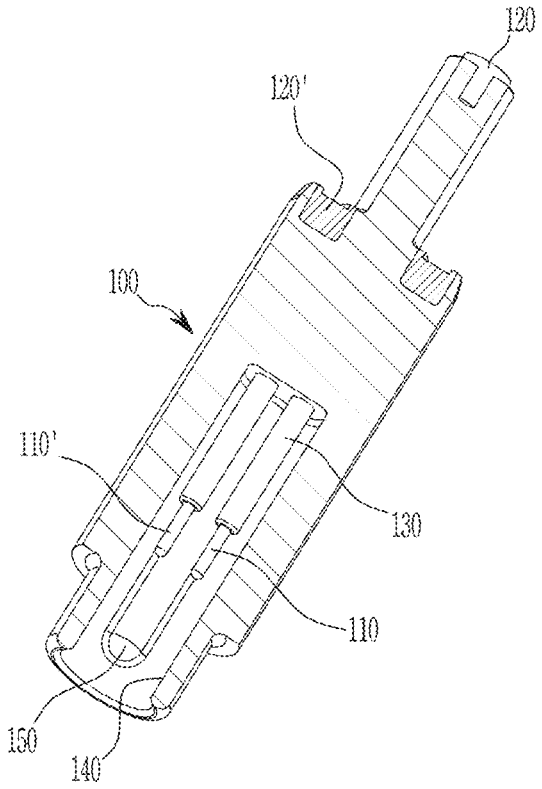
FIG. 4 is a partial cut-out perspective view of a cap plug of the dual spark plug according to the embodiment of the present disclosure.
Figure 5:
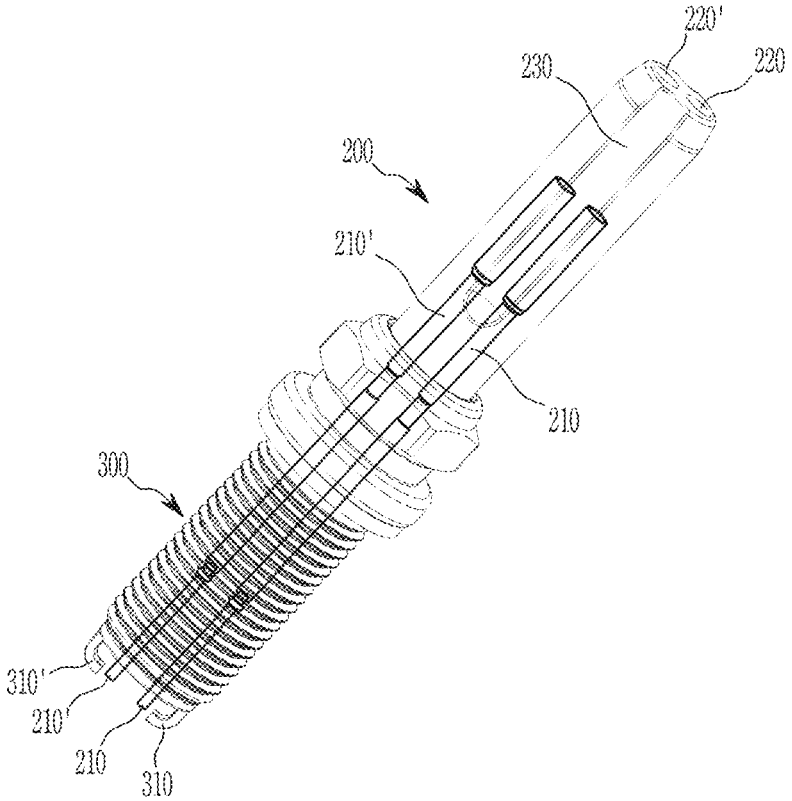
FIG. 5 is a partial transparent perspective view of an upper body and a lower body of the dual spark plug according to the embodiment of the present disclosure.

FIG. 1 is a cross-sectional view of a configuration of a dual spark plug according to an embodiment of the present disclosure. FIG. 2 is a side view of the configuration of the dual spark plug according to the embodiment of the present disclosure. FIG. 3 is a transparent perspective view of a part of the dual spark plug according to the embodiment of the present disclosure. FIG. 4 is a partial cut-out perspective view of a cap plug of the dual spark plug according to the embodiment of the present disclosure. In addition, FIG. 5 is a partial transparent perspective view of an upper body and a lower body of the dual spark plug according to the embodiment of the present disclosure.

As shown in FIGS. 1-5, a dual spark plug according to an embodiment of the present disclosure may include a cap plug 100 formed of an insulating material, an upper body 200 coupled with the cap plug 100, and a lower body 300 integrally formed with the upper body 200 and formed of a metallic material.

The cap plug 100 is generally formed in a long cylinder shape in the up and down directions and the lower part is open to form an upper insertion groove 140. The cap plug 100 is formed of an insulating material and, for example, the cap plug 100 may be made of glass fiber.

A pair of plug center electrodes 110 and 110' are provided in the cap plug 100. The pair of plug center electrodes 110 and 110' may include a first plug center electrode and a second plug center electrode. The pair of plug center electrodes 110 and 110' may be disposed at a predetermined interval within the cap plug 100.

A pair of plug center electrodes 110 and 110' are electrically connected to an ignition coil (not shown). For this, a central terminal 120 that is electrically connected with one (e.g., the first plug center electrode) of the pair of plug center electrodes 110 and 110' and an outer terminal 120' that is electrically connected with the other one (e.g., the second plug center electrode) of the pair of plug center electrodes 110 and 110' are formed in the cap plug 100.

The central terminal 120 and the outer terminal 120' are respectively connected with an ignition coil. The central terminal 120 and the outer terminal 120' are spaced a predetermined distance in the up and down directions. The outer terminal 120' is formed in a generally hollow ring shape. Thus, it can be disposed by being spaced a predetermined distance outside the radial direction of the central terminal 120. As described, since the outer terminal 120' and the central terminal 120 are disposed apart at regular intervals in the up and down directions and radial directions, it is possible to minimize occurrence of electrical interference or noise between a pair of plug center electrodes 110 and 110' when a high voltage (or high current) is applied to the central terminal 120 and the outer terminal 120'. The central terminal 120 may be integrally formed with the first plug center electrode and the outer terminal 120' may be integrally formed with the second plug center electrode.

At least one upper guide groove or upper guide protrusion 150 is formed in an inner side of the upper insertion groove 140 to guide assembly with the upper body 200.

The upper guide groove or upper guide protrusion 150 may extend in the up and down directions.

The pair of plug center electrodes 110 and 110' provided in the cap plug 100 may be extended to the inside of the upper insertion groove 140. The pair of plug center electrodes 110 and 110' extended to the inside of the upper insertion groove 140 are wrapped by an insulation cap 130 that is formed of an insulating material. Ends of the pair of plug center electrodes 110 and 110' are not covered by the insulation cap 130 and are exposed to the outside.

The cap plug 100 may be manufactured by press molding in a state in which a first center electrode provided with the central terminal 120 and a second center electrode provided with the outer terminal 120' are disposed in the mold.

The upper body 200 is generally formed in a long cylinder shape extending in the up and down directions, and an upper part of the upper body 200 is inserted into the upper insertion groove 140 formed in the cap plug 100. The upper body 200 may be made of a ceramic material.

A pair of upper center electrodes 210 and 210' electrically connected to the pair of plug center electrodes 110 and 110' provided inside the cap plug 100 are provided inside the upper body 200. The pair of upper center electrodes 210 and 210' include a first upper center electrode and a second upper center electrode. The pair of upper center electrodes 210 and 210' may be disposed at a predetermined interval within the upper body 200.

A lower guide protrusion corresponding to an upper guide groove formed in the upper insertion groove 140 of the cap plug 100 or a lower guide groove 230 corresponding to the upper guide protrusion 150 may be formed in an upper exterior circumference of the upper body 200.

A pair of plug holes 220 and 220' extending in the up and down directions are formed in the upper body 200. A pair of upper center electrodes 210 and 210' are provided inside the plug holes 220 and 220'.

Lower ends of the pair of upper center electrodes 210 and 210' provided inside the pair of plug holes 220 and 220' protrude under the upper body 200.

An upper end of the upper center electrode provided inside the plug holes 220 and 220' is formed as a clip-type terminal. A lower end of the plug center electrode is coupled to the clip-type terminal of the upper center electrode. Therefore, the plug center electrode and the upper center electrode are electrically connected. As described, by forming the upper end of the upper center electrode as a clip-type terminal, it is possible to facilitate the coupling and release of the plug center electrode and the upper center electrode.

In addition, the diameter of the plug holes 220 and 220' is formed to correspond to the exterior diameter of the insulation cap 130 that wraps the plug center electrode. When the plug center electrode is inserted into the plug holes 220 and 220', the insulation cap 130 is assembled in the plug holes 220 and 220' by force fitting. As described, since the insulation cap 130 is forcibly fitted into the plug holes 220 and 220', formation of an air gap between the plug holes 220 and 220' and the plug center electrode can be prevented.

In other words, since the cap plug 100 provided with the pair of center electrodes and the upper body 200 is formed of an insulating material, an occurrence of electricity between the pair of center electrodes is primarily prevented. However, when assembling the cap plug 100 and the upper body 200, an air gap may be formed between a pair of center electrodes due to various causes. As described, when an air gap is formed between the center electrodes, electricity may occur between the pair of center electrodes to which a high voltage is applied due to the air gap.

However, according to the embodiment of the present disclosure, when the plug center electrode protruded toward the upper insertion groove 140 of the cap plug 100 is wrapped with the insulation cap 130 and the cap plug 100 and the upper body 200 are combined, the insulation cap 130 is inserted into the plug holes 220 and 220' by force fitting. Thus, an air gap is prevented from forming between a pair of center electrodes. Therefore, it is possible to prevent electricity from being generated between the pair of center electrodes to which a high voltage is applied due to the air gap.

The lower body 300 is integrally formed with the upper body 200 and is generally formed in a cylinder shape.

A pair of ground electrodes 310 and 310' are formed on respective sides of the lower body of the lower body 300. The pair of ground electrodes 310 and 310' extend radially inward from both lower sides of the lower body 300 and are spaced apart from the pair of upper center electrodes 210 and 210' protruded under the upper body 200. A spark discharge occurs between the pair of ground electrodes 310 and 310' and the pair of center electrodes 210 and 210'.

The lower body 300 is a part that is coupled to a cylinder of an engine. A thread 320 is formed in the lower exterior circumference of the lower body 300 for coupling with the cylinder. Another thread corresponding to the thread of the lower body 300 may be formed on the cylinder of the engine. In other words, the dual spark plug and the cylinder of the engine are screwed together. The lower body 300 and the cylinder of the engine are screwed together, so that the lower body 300 and the ground electrode form a ground end (i.e., a (−) electrode).

Hereinafter, an assembly method of the dual spark plug according to an embodiment of the present disclosure as described above is described in detail.

The pair of plug center electrodes 110 and 110' protruded into the inside of the upper insertion groove 140 formed in the cap plug 100 are inserted into the plug holes 220 and 220' formed in the upper body 200. In this case, since the insulation cap 130 that wraps the pair of plug center electrodes 110 and 110' is inserted into the plug holes 220 and 220' by force fitting, an air gap is prevented from forming between the pair of plug center electrodes 110 and 110'.

In addition, the end of the plug center electrode that is not wrapped with the insulation cap 130 is inserted into the upper center electrode formed as a clip-type terminal. Thus, the plug center electrode and the upper center electrode are electrically connected. As the plug center electrode is coupled to fit into the upper center electrode formed as a clip-type terminal, assembling of the plug center electrode and the upper center electrode is facilitated.

In addition, since the cap plug 100 and the upper body 200 are combined as the upper guide protrusion 150 (or the upper guide groove) formed in the upper insertion groove 140 of the cap plug 100 are inserted into the lower guide groove 230 (or the lower guide protrusion) formed in the exterior circumference of the upper body 200, the cap plug 100 and upper body 200 may be more easily assembled.

While this disclosure has been described in connection with what is presently considered to be practical embodiments, it is to be understood that the scope of the present disclosure is not limited to the disclosed embodiments. On the contrary, the present disclosure is intended to cover various modifications and equivalent arrangements included within the spirit and scope of the appended claims.

DESCRIPTION OF SYMBOLS

100: cap plug
110, 110': plug center electrode
120: central terminal
120': outer terminal
130: insulation cap
140: upper insertion groove
150: upper guide protrusion
200: upper body
210, 210': upper center electrode
220: plug hole
230: lower guide groove
300: lower body
310, 310': ground electrode
320: thread

What is claimed is:

1. A dual spark plug comprising:
a cap plug formed of an insulation material;
an upper body that is coupled with the cap plug and formed of an insulation material;
a lower body that is integrally formed with the upper body and that is provided at an outer side of the upper body;
a pair of plug center electrodes provided inside the cap plug;
a pair of upper center electrodes provided inside the upper body and electrically connected with the pair of plug center electrodes;
insulation caps provided to wrap the pair of plug center electrodes, respectively; and
a pair of ground electrodes extended from opposite sides of the lower body and disposed at a predetermined distance from the pair of upper center electrodes, respectively.

2. The dual spark plug of claim 1, wherein an upper insertion groove is formed in a lower part of the cap plug, and wherein an upper exterior diameter of the upper body is formed to correspond to an interior diameter of the upper insertion groove such that the upper body is inserted into the upper insertion groove.

3. The dual spark plug of claim 1, wherein the pair of plug center electrodes wrapped with the insulation caps extend into the upper insertion groove, and
wherein a pair of plug holes are formed in the upper body for insertion of the pair of center electrodes extended into the upper insertion groove.

4. The dual spark plug of claim 1, wherein
the cap plug includes
a central terminal that is electrically connected with one of the pair of plug center electrodes, and an outer terminal that is electrically connected with the other one of the pair of plug center electrodes.

5. The dual spark plug of claim 4, wherein the outer terminal is disposed to be spaced a predetermined distance from the central terminal in up and down directions and is disposed to be spaced a predetermined distance from the central terminal at an outside in the radial direction of the central terminal.

6. The dual spark plug of claim 5, wherein the outer terminal is formed in a ring shape with an empty center.

7. The dual spark plug of claim 3, wherein the pair of upper center electrodes are provided inside the plug hole, and ends of the pair of upper center electrodes are formed as clip-type terminals such that the upper center electrodes are electrically connected with the pair of plug center electrodes.

8. The dual spark plug of claim 7, wherein ends of the pair of plug center electrodes are forcibly fitted into the pair of upper center electrodes that are provided as clip-type terminals.

9. The dual spark plug of claim 1, wherein at least one upper guide protrusion is formed in an interior side of the upper insertion groove of the cap plug, and a lower guide groove that corresponds to the upper guide protrusion is formed in an exterior circumference of the upper body.

10. The dual spark plug of claim 1, wherein at least one upper guide groove is formed in an interior side of the upper insertion groove of the cap plug, and a lower guide protrusion that corresponds to the upper guide groove is formed in an exterior circumference of the upper body.

11. The dual spark plug of claim 1, wherein a thread is formed in an exterior circumference of the lower body.

12. The dual spark plug of claim 1, wherein the upper body and the lower body are integrally formed.

* * * * *